US005450107A

United States Patent [19]

Rawson

[11] Patent Number: 5,450,107

[45] Date of Patent: Sep. 12, 1995

[54] SURFACE RIPPLE WAVE SUPPRESSION BY ANTI-REFLECTION IN APERTURED FREE INK SURFACE LEVEL CONTROLLERS FOR ACOUSTIC INK PRINTERS

[75] Inventor: Eric G. Rawson, Saratoga, Calif.

[73] Assignee: Xerox Corporation, Stamford, Conn.

[21] Appl. No.: 814,843

[22] Filed: Dec. 27, 1991

[51] Int. Cl.[6] ..... B41J 2/135; B41J 2/14

[52] U.S. Cl. ..... 347/46; 347/47

[58] Field of Search ..... 346/140 R, 75; 310/313 R; 347/46, 47

[56] References Cited

U.S. PATENT DOCUMENTS

| | | | |
|---|---|---|---|
| 4,308,547 | 12/1981 | Lovelady et al. | 346/140 R |
| 4,403,234 | 9/1983 | Miura et al. | 346/140 R |
| 4,751,530 | 6/1988 | Elrod et al. | 346/140 |
| 4,962,391 | 10/1990 | Kitahara et al. | 346/140 R |
| 5,028,937 | 7/1991 | Khuri-Yakub et al. | 346/140 |
| 5,041,849 | 8/1991 | Quate et al. | 346/140 |

*Primary Examiner*—Peter S. Wong
*Assistant Examiner*—Eric Frahm

[57] ABSTRACT

In response to the foregoing need, the cap structures that are provided by this invention for controlling the free ink surface levels of acoustic ink printers are characterized by having aperture configurations that are more or less equally subdivided into "reflectively balanced" sectors that radially differ from each other by $\frac{1}{4}$ of the dominant wavelength of the surface ripple waves that are generated by the droplet ejection process. The $\frac{1}{4}$ wavelength difference in the radii of the two generally equal reflectively balanced fractional parts of these apertures causes the dominant frequency components of the retroreflected ripple waves to destructively interfere with each other in the critical central regions of the apertures.

7 Claims, 3 Drawing Sheets

SURFACE RIPPLE WAVE SUPPRESSION BY ANTI-REFLECTION IN APERTURED FREE INK SURFACE LEVEL CONTROLLERS FOR ACOUSTIC INK PRINTERS

FIELD OF THE INVENTION

This invention relates to apertured cap structures for controlling the free ink surface levels of acoustic ink printers and, more particularly, to improved aperture configurations for these cap structures.

CROSS-REFERENCE

A commonly assigned Khuri-Yakub et al. U.S. Pat. No. 5,028,937, which issued Jul. 2, 1991 on "Perforated Membranes for Liquid Control in Acoustic Ink Printing," suggests using apertured cap structures for controlling the free ink surface levels of acoustic ink printers. This invention and the invention disclosed in a commonly assigned, concurrently filed U.S. patent application of Eric G. Rawson, which was filed under Ser. No. 07/815,002 on "Surface Ripple Wave Diffusion in Apertured Free Ink Surface Level Controllers for Acoustic Ink Printers", U.S. Pat. No .5,216,451, both build on the teachings of the Khuri-Yakub et al. '937 patent, so that patent hereby is incorporated by reference.

More particularly, it has been found that the free ink surface level control that is provided by the apertured cap structures of the '937 patent tends to be degraded, under dynamic operating conditions, by the reflection of surface ripple waves from the sidewalls of the essentially round apertures of those cap structures. These ripple waves are generated as an inherent byproduct of the droplet ejection process, so the oscillatory free ink surface level perturbations that are caused by the reflection of the ripple waves from the aperture sidewalls threaten to impose unwanted constraints on the droplet ejection rates at which printers that utilize such cap structures can be operated reliably in an asynchronous mode (i.e., a mode in which the ejection timing of each droplet is independent of the ejection timing of every other droplet). Therefore, in accordance with this invention, the time that is required for the amplitude of these perturbations to dissipate to a negligibly low level is reduced significantly by configuring the apertures to at least partially suppress the reflected ripple waves by destructive interference. In contrast, the invention that is covered by the above-identified Rawson application achieves a similar result by configuring the apertures to scatter the reflected ripple waves.

BACKGROUND OF THE INVENTION

As described herein, "acoustic ink printing" is a direct marking process that is carried out by modulating the radiation pressure that one or more focused acoustic beams exert against a free surface of a pool of liquid ink, whereby individual droplets of ink are ejected from the free ink surface on demand at a sufficient velocity to cause the droplets to deposit in an image configuration on a nearby recording medium. This process does not depend on the use of nozzles or small ejection orifices for controlling the formation or ejection of the individual droplets of ink, so it avoids the troublesome mechanical constraints that have caused many of the reliability and picture element ("pixel") placement accuracy problems that conventional drop-on-demand and continuous-stream ink jet printers have experienced.

Several different droplet ejector mechanisms have been proposed for acoustic ink printing. For example, (1) Lovelady et al. U.S. Pat. No. 4,308,547, which issued Dec. 29, 1981 on "Liquid Drop Emitter," provides piezoelectric shell-shaped transducers; (2) a commonly assigned U.S. Pat. No. 4,697,195, which issued Sep. 29, 1987 on "Nozzleless Liquid Drop Emitters," provides planar piezoelectric transducers with interdigitated electrodes (referred to as "IDTs"); (3) a commonly assigned Elrod et al. U.S., Pat. No. 4,751,530, which issued Jun. 14, 1988 on "Acoustic Lens Arrays for Ink Printing," provides droplet ejectors that utilize acoustically illuminated spherical focusing lens; and (4) a commonly assigned Quate et al. U.S. Pat. No. 5,041,845, which issued Aug. 20, 1991 on "Multi-Discrete-Phase Fresnel Acoustic Lenses and Their Application to Acoustic Ink Printing," provides droplet ejectors that utilizes acoustically illuminated multi-discrete-phase Fresnel focusing lenses.

Droplet ejectors having essentially diffraction-limited, f/1 lenses (either spherical lenses or multi-discrete-phase Fresnel lenses) for bringing the acoustic beam or beams to focus essentially on the free ink surface have shown substantial promise for high quality acoustic ink printing. Fresnel lenses have the practical advantage of being relatively easy and inexpensive to fabricate, but that distinction is not material to this invention. Instead, the feature of these lenses that most directly relates to this invention is that they are designed to be more or less diffraction-limited f/1 lenses, which means that their depth of the focus is only a few wavelengths $\lambda$; where $\lambda$ is the wavelength in the ink of the acoustic radiation that is focused by them. In practice, $\lambda$ typically is on the order of only 10 $\mu$m or so, which means that the free ink surface levels of these high quality acoustic ink printers usually have to be controlled with substantial precision.

Apertured cap structures are economically attractive free ink surface level controllers for acoustic ink printing. As pointed out in the above-referenced Khuri-Yakub et al. '937 patent, an apertured cap structure utilizes the inherent surface tension of the ink to counteract the tendency of the free ink surface level to change as a function of small changes in the pressure of the ink. Thus, for example, an apertured cap structure is useful for increasing the tolerance of an acoustic ink printer to the ink pressure variations that can be caused by slight mismatches between the rates at which its ink supply is depleted and replenished. Furthermore, as taught by the '937 patent, a pressure regulator or the like can be employed for maintaining a substantially constant bias pressure on the ink whenever it is necessary or desirable to increase the precision of the surface level control that is provided by such a cap structure.

The fluid dynamics of the acoustic ink printing process generate a generally circular wavefront ripple wave on the free ink surface whenever a droplet of ink is ejected. The viscosity of the ink hydrodynamically dampens this surface ripple wave as it propagates away from the ejection site. However, in printers that have multiple droplet ejectors, such as those that comprise one or more linear arrays of droplet ejectors for line printing, this hydrodynamic damping generally is insufficient to prevent the ripple waves produced by any given one of the droplet ejectors from interfering with the operation of its near neighboring droplet ejectors.

Accordingly, to avoid this unwanted "crosstalk," a multi-ejector printer advantageously includes a cap structure that has a plurality of spatially distributed apertures that surround the ejection sites of respective ones of the droplet ejectors. A cap structure of this type effectively subdivides the free ink surface of the printer into a plurality of individual ponds of ink, each of which is dedicated to a different one of the droplet ejectors. Ink may flow from pond-to-pond between the ejectors and such a cap structure, but the cap structure acts as a physical barrier for inhibiting surface ripple waves from propagating from one pond to another. In operation, the acoustic beams that are emitted by the droplet ejectors of such a multi-ejector printer come to focus more or less centrally of respective ones of the apertures in the cap structure, so the aperture diameters preferably are at least approximately five times greater than (and, indeed, may be twenty or more times greater than the waist diameters of the focused acoustic beams, thereby preventing the apertures from materially influencing the hydrodynamics of the droplet ejection process or the size of the droplets of ink that are ejected. For example, if the acoustic beams have nominal waist diameters at focus of about 10 $\mu$m, the apertures suitably have diameters of approximately 250 $\mu$m. These relatively large apertures are practical, even for printers that print pixels on centers that are spatially offset by only a small fraction of the aperture diameter, because the droplet ejectors of these higher resolution printers can be, for example, spatially distributed among multiple rows on staggered centers.

As previously pointed out, prior cap structures of the foregoing type have had essentially round apertures. A round aperture configuration suggests itself because of its circular symmetry. However, it now has been found that the retroreflection of the surface ripple waves from the sidewalls of these round apertures is a limiting factor that interferes with operating acoustic ink printers having such cap structures at higher asynchronous droplet ejection rates. Consequently, an aperture configuration that significantly reduces the effect of such surface ripple waves on the acoustic ink printing process is needed to enable such cap structures to be used as free ink surface level controllers for higher speed, asynchronous acoustic ink printers.

SUMMARY OF THE INVENTION

In response to the foregoing need, the cap structures that are provided by this invention for controlling the free ink surface levels of acoustic ink printers are characterized by having aperture configurations that are subdivided into "reflectively balanced" sectors that radially differ from each other by $\frac{1}{4}$ of the dominant wavelength of the surface ripple waves that are generated by the droplet ejection process. The $\frac{1}{4}$ wavelength difference in the radii of the two reflectively balanced fractional parts of these apertures causes the dominant frequency components of the retroreflected ripple waves to destructively interfere with each other in the critical central regions of the apertures.

BRIEF DESCRIPTION OF THE DRAWINGS

Additional features and advantages of this invention will become apparent when the following detailed description is read in conjunction with the attached drawings, in which.

DETAILED DESCRIPTION OF THE ILLUSTRATED EMBODIMENT

While the invention is described in some detail hereinbelow with reference to certain embodiments, it is to be understood that there is no intent to limit it to those embodiments. On the contrary, the intent is to cover all alternatives, modifications and equivalents that fall within the spirit and scope of this invention as defined by the appended claims.

Figure 1:
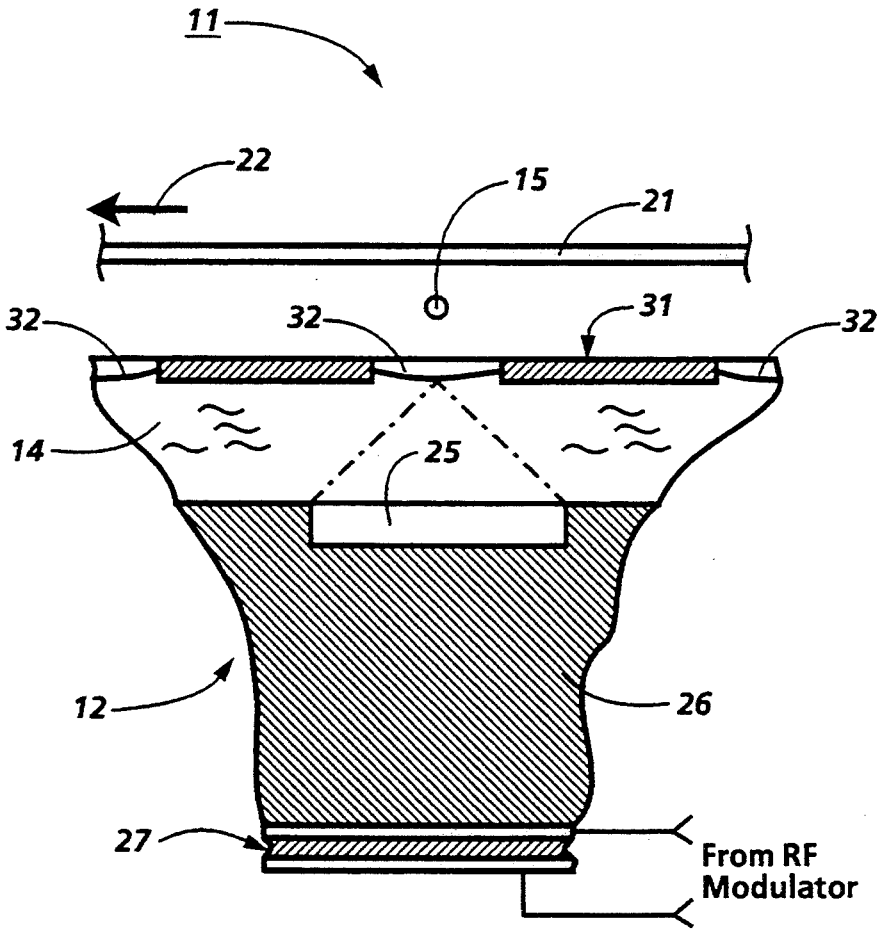
FIG. 1 is a fragmentary and simplified, partially sectioned, elevational view of an acoustic ink printer having an apertured cap structure constructed in accordance with the present invention.

Turning now to the drawings, and at this point especially to FIG. 1, there is an acoustic ink printer 11 (shown only in relevant part) that has one or more droplet ejectors 12 for ejecting individual droplets of ink from the free surface 13 of a pool of liquid ink 14 on demand at a sufficient velocity to deposit the droplets 15 in an image configuration on a nearby recording medium 21. For example, the printer 12 suitably comprises a one or two dimensional array (not shown) of droplet ejectors 12 for sequentially printing successive lines of an image on the recording medium 21 while it is being advanced (by means not shown) in a process direction, as indicated by the arrow 22.

As illustrated, each of the droplet ejectors 12 comprises an acoustic lens 25, which typically is an essentially diffraction-limited f/1 lens, that is formed in one face of a suitable substrate 26. This lens 25 is acoustically coupled to the free surface 13 of the ink 14, either by the ink 14 alone (as shown) or via an intermediate single or multiple layer, liquid and/or solid acoustic coupling medium (not shown). The other or opposite face of the substrate 26 is bonded to or otherwise maintained in intimate mechanical contact with a piezoelectric transducer 27. As a general rule, the substrate 26 is composed of a material (such as silicon, alumina, sapphire, fused quartz, and certain glasses) that has a much higher acoustic velocity than the ink 14, so the lens 25 typically is configured to behave as a spherical concave focusing element for the acoustic radiation that is incident upon it.

In operation, the transducer 27 suitably is excited by an amplitude modulated rf signal that causes it to couple an amplitude modulated, generally planar wavefront, acoustic wave into the substrate 26 for illuminating the lens 25. The lens 25 refracts the incident radiation and bring it to focus essentially on the free ink surface 13, so the radiation pressure that is exerted against the free ink surface 13 makes brief controlled excursions to a sufficiently high pressure level for ejecting individual droplets of ink 15 therefrom under the control of amplitude modulated rf signal that is applied to the transducer 27 (not shown). Typically, the transducer 27 is excited at an rf frequency of about 160 MHz, and the amplitude of that rf excitation is pulsed at a pulse rate of up to about 20 KHz.

In keeping with the teachings of the above-referenced Khuri-Yakub '937 patent, the free ink surface 13 is capped by an apertured cap structure 31 which is supported (by means not shown) so that its inner face is maintained in intimate contact with the ink 14. As shown, the cap structure 31 has a separate aperture 32 for each of the droplet ejectors 12, so the acoustic beam that is emitted by any given one of the droplet ejectors 12 comes to focus on the free ink surface 13 more or less centrally of an aperture 32 that effectively isolates that potential ejection site from the ejection sites of the other droplet ejectors 12. As previously pointed out, each of the apertures 32 is sized to have a diameter that is much larger (i.e., at least approximately five times greater than and, in some cases, twenty times or more times larger) than the waist diameter of the focused acoustic beam, so the apertures 32 have no material affect upon the formation, size or directionality of the droplet of ink 15 that are ejected.

As will be understood, the free ink surface 13 forms a meniscus 35 across each of the apertures 32 because of its surface tension. Furthermore, the capillary attraction between the ink 14 and the aperture sidewalls resists any tendency this meniscus 35 may have to shift upwardly or downwardly within the aperture 32 as a function of any slight changes in the volume of the ink 14, so the cap structure 31 effectively stabilizes the free ink surface level, at least under quiescent operating conditions. However, the free ink surface level still is dynamically instable because the droplet ejection process inherently generates surface ripple waves. This is a hydrodynamically damped instability, so the challenge is to reduce the time that is required for the perturbations to dissipate to a negligibly low amplitude.

Figure 2:
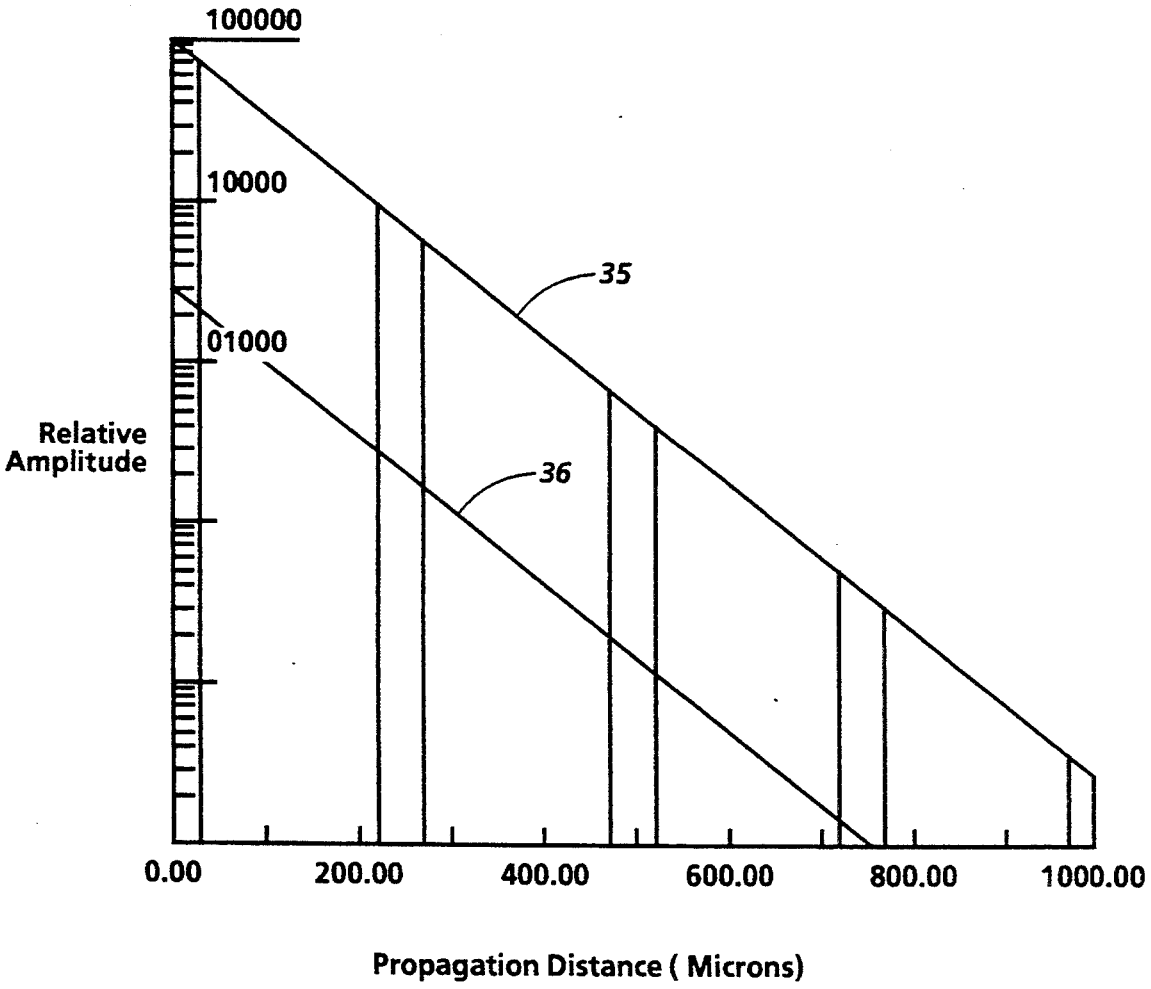
FIG. 2 is a first order graphical approximation of the relative ripple wave amplitude in the central region of a round aperture as a function of the wave propagation distance.

Referring to FIG. 2, conventional ray analysis techniques are useful for determining the amplitude versus time characteristics of the transient oscillatory perturbations that disturb the level of the free ink surface 13 within the critical central region of the aperture 32 immediately after a droplet of ink 15 is ejected therefrom. FIG. 2 is based on the assumptions that the aperture 32 is a round aperture having a diameter of 250 $\mu$m and that its so-called "critical central region" is a concentric circular area having a diameter of 50 $\mu$m (i.e., an area that is sufficiently proximate the ejection site that perturbations occurring within it are likely to have a meaningful influence on the ejection process). The amplitude of the perturbations has been normalized to unity at the time of droplet ejection, and their amplitude has been plotted as a function of the distance the ripple wave has propagated (which is proportional to time since the propagation velocity is substantially constant).

As would be expected, the surface ripple wave initially is contained within the central critical region of the aperture 32. The ripple wave then propagates outwardly to the aperture sidewalls, where it is reflected back toward the center of the aperture 32, so it re-enters the central region of the aperture 32 to complete a first roundtrip. This propagation/reflection process repeats itself, so the level of the free ink surface 13 in the central region of the aperture 32 is periodically perturbed, with the amplitude of this oscillatory perturbation decaying at a rate, as indicated by the line 35 in FIG. 2, that is determined by the exponential attenuation that the surface wave experiences as it propagates. The impact of the retroreflectivity of the generally round (i.e., circularly configured) aperture 32 on the amount of time that is required for the amplitude of these oscillatory perturbations to decay to a negligibly low level will be evident when their instantaneous amplitude, as represented by the line 35, is compared on a corresponding time scale with the asymptote 36, which represents the amplitude of the perturbations that would exist within the central region of the aperture 32 if the surface ripple wave was decomposed into wavelets uniformly distributed over the full span of the aperture 32 (the amplitude of the asymptote 36 tracks the amplitude of decay rate 35, but is only 4% as high because the critical central region of the aperture 32 has been assumed to be 4% of the total transverse-sectional area of the aperture 32).

Figure 3:
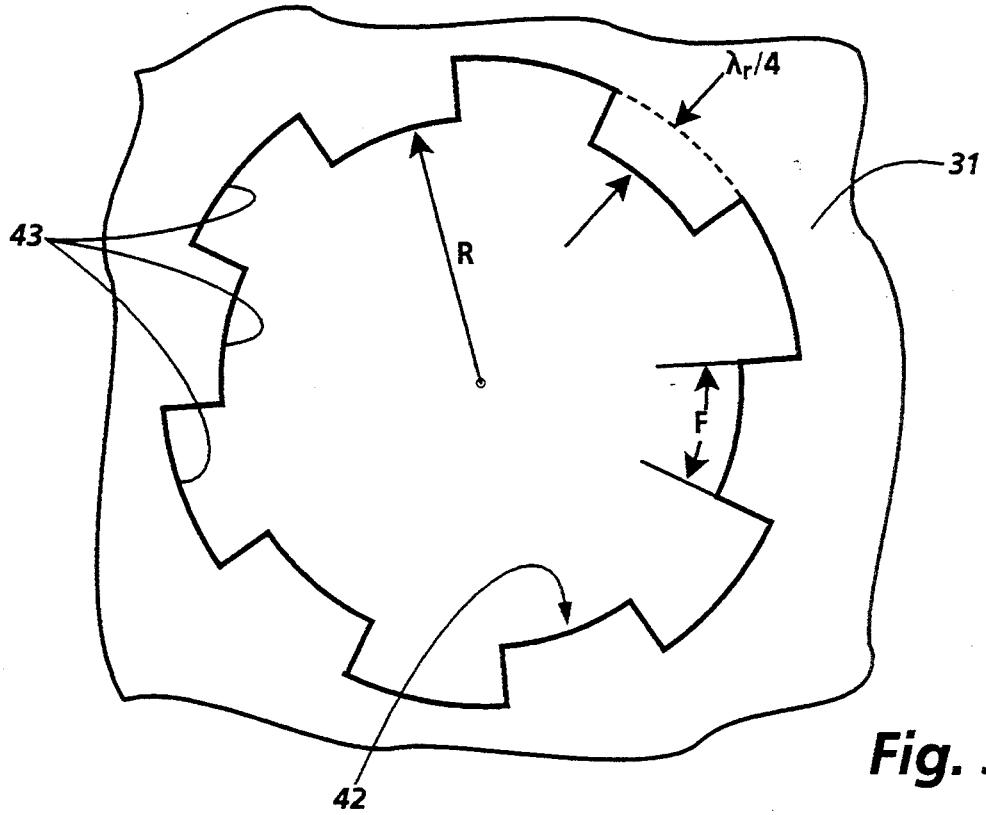
FIG. 3 is a plan view of an aperture that has a $\frac{1}{4}$ wavelength stepped configuration in keeping with one implementation of this invention.

Turning now to FIG. 3, in accordance with this invention, there is an aperture 42 that has a stepped contour that is tuned so that it periodically varies by $\frac{1}{4}$ of the dominant (i.e., most damaging or troublesome) wavelength, $\lambda_r$, of the surface ripple wave. More particularly, the depth of the steps that are formed in the periphery of the aperture 42 typically are tuned to the ripple wave frequency that causes the most severe perturbation at the center of the aperture 42 after one round trip. Each of the facets 43 of the stepped aperture 42 subtends essentially the same angle about the center of the aperture, and that angle is selected so that there are an even number of facets 43 circumferentially of the aperture 42. This effectively subdivides the circumference of the aperture into two fractional parts that are radially offset from each other by $\frac{1}{4}\lambda r$. Somewhat more generally, it will be seen that the radius of the aperture 42 periodically varies through a predetermined number of full cycles circumferentially of the aperture 42 by a distance $\frac{1}{4}n\lambda r$, where n is an odd integer.

As will be understood, the lengths, F, of the facets 43 may vary from being substantially shorter to substantially longer than $\lambda_r$. If $F \geqq \lambda_r$ most of the ripple wave energy at the frequency to which the aperture 42 is tuned will be retroreflected toward the center of the aperture, thereby effectively canceling out a large part of that energy. Indeed, to optimize the cancellation that is achieved, the ratio of the facet lengths at radius r to the facet lengths at radius $r+\lambda_r$ can be increased or decreased while designing the aperture 42 to ensure that the amplitudes of the ripple waves that are retroreflected by those two sets of facets are essentially equal at the center of the aperture 42 (i.e., "reflectively balanced"). It is believed that the retroreflectivity of the facets 43 (and, thus, the efficiency of the destructive interference that is produced) may be inversely related, at least in some instances, to the spatial frequency of the facets 43 circumferentially of the aperture 42. Thus, an aperture (not shown) that is composed of just a few $\frac{1}{4}\lambda r$ radially offset facets 43 may provide the most efficient cancellation of the $\lambda_r$ component of the ripple wave.

On the other hand, if $F < \lambda_r$, some of the ripple wave energy to which the aperture 42 is tuned will be diffractively scattered by the apertures 42, thereby dispersing it (rather than canceling it).

While the aperture 42 is anti-reflective only at one frequency and the odd harmonics of that frequency, it is to be understood that the other frequency components of the surface ripple waves that are generated by the droplet ejection process typically have much longer or shorter wavelengths than wavelength, $\lambda_r$, to which the aperture 42 is tuned. Fortunately, the longer wavelength components tend to decay at a sufficiently high rate that they no not significantly affect the free ink surface level even after just one round trip. The longer wavelength components decay more slowly, but the perturbations that they produce on the free ink surface have gentler slopes and, therefore, do not so severely affect the directionality of the droplets of ink 15 (FIG. 1) that are ejected.

Figure 4:
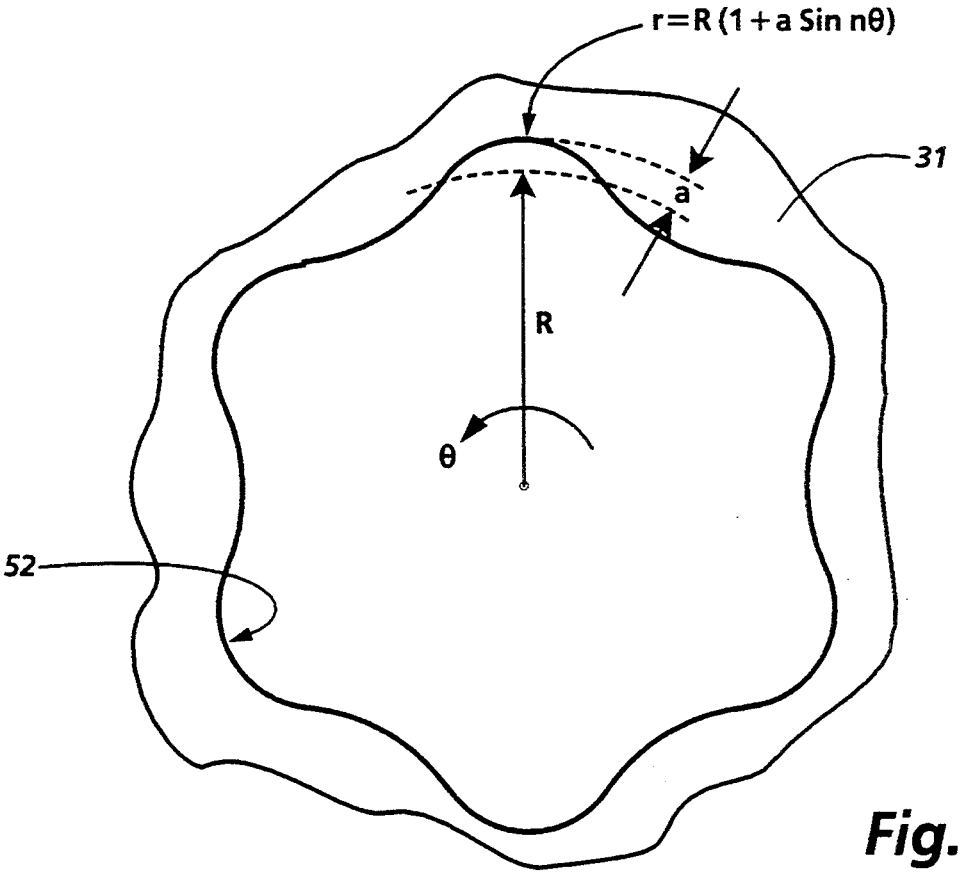
FIG. 4 is a plan view of an aperture configuration that has a $\frac{1}{4}$ wavelength sinusoidally varying configuration in keeping with another implementation of this invention.

Alternatively, as shown in FIG. 4, the cap structure 31 (FIG. 1) may have sinusoidally configured apertures 52, each of which has a radius that varies by order of $\frac{1}{4}\lambda_r$ over one or more full cycles about its circumference (this radial variation of the aperture 52 is represented in FIG. 4 by the amplitude "a" of the sinusoid). As will be appreciated, such an aperture configuration functions as a sinusoidal diffraction grating for the frequency to which it is tuned, so incident ripple wave energy at that frequency would be diffracted into a zero order and positive and negative higher order diffraction components. The higher order diffraction components, on the other hand, would propagate from the sidewall of the aperture 52 at their respective diffraction angles, thereby angularly scattering them away from the critical central region of the aperture 42.

CONCLUSION

In view of the foregoing it now will be evident that this invention significantly increases the droplet ejection rates at which acoustic ink printers that utilize apertured cap structures for free ink surface level control can be operated asynchronously. Moreover, it will be evident that this improved performance can be achieved at little, if any, additional cost.

What is claimed:

1. In an acoustic ink printer having at least one droplet ejector for ejecting individual droplets of ink of predetermined maximum diameter from a free surface of a pool of liquid ink on demand, an improved cap structure for holding said free surface at a predetermined level; said improved cap structure comprising a body having a dedicated aperture formed therethrough for each droplet ejector, thereby providing an isolated portion of the free ink surface for each droplet ejector, said aperture having a radius that periodically varies, through a predetermined number of full cycles circumferentially of said aperture, by a distance of approximately $\frac{1}{4}n\lambda_r$, where n is an odd integer and $\lambda_r$ is a wavelength for which said aperture is tuned to be anti-reflective.

2. The acoustic ink printer of claim 1 wherein each droplet ejector includes means for illuminating said portion of said free ink surface with an amplitude modulated, substantially focused acoustic beam for ejecting droplets of ink therefrom on demand, and said acoustic beam is incident on said free ink surface generally centrally of the aperture dedicated to said droplet ejector.

3. The acoustic ink printer of claim 2 wherein said acoustic beam has a predetermined maximum waist diameter at focus; and the diameter of said aperture is at least approximately five times larger than the waist diameter of said beam.

4. The acoustic ink printer of any of claims 1–3 wherein said aperture has a radially stepped configuration.

5. The acoustic ink printer of claim 4 wherein the diameter of said aperture is on the order of twenty times larger than the waist diameter of said beam.

6. The acoustic ink printer of any of claims 1–3 wherein said aperture has a radially varying sinousoidial configuration.

7. The acoustic ink printer of claim 6 wherein the diameter of said aperture is on the order of twenty times larger than the waist diameter of said beam.

* * * * *